United States Patent [19]

Kiss

[11] Patent Number: 4,759,091

[45] Date of Patent: Jul. 26, 1988

[54] BRUSH ASSEMBLY FOR BATH OR SHOWER USE

[76] Inventor: Miklos Kiss, 1821 SE. Giles St., Roseburg, Oreg. 97470

[21] Appl. No.: 2,373

[22] Filed: Jan. 12, 1987

[51] Int. Cl.[4] ..... A47K 7/02

[52] U.S. Cl. ..... 15/105; 15/160; 4/606; 248/215; 248/340; 81/3.55

[58] Field of Search ..... 15/105, 104.92, 104.93, 15/160, 216, 217; 4/605, 606; 254/120; 248/215, 110, 340; 211/65; 81/3.55

[56] References Cited

U.S. PATENT DOCUMENTS

| | | | |
|---|---|---|---|
| 2,503,683 | 4/1950 | Perkins | 81/3.55 X |
| 3,631,560 | 1/1972 | Atkins | 15/146 |
| 3,750,226 | 8/1973 | Morgan | 15/187 |
| 4,020,519 | 5/1977 | Robinson | 4/606 X |
| 4,417,362 | 11/1983 | Walker | 15/160 X |
| 4,510,872 | 4/1985 | Parry | 248/340 X |

FOREIGN PATENT DOCUMENTS

| | | | |
|---|---|---|---|
| 654890 | 7/1951 | United Kingdom | 248/215 |

*Primary Examiner*—Peter Feldman

*Attorney, Agent, or Firm*—James D. Givnan, Jr.

[57] ABSTRACT

A brush assembly having a pair of elongate brushes mounted in a spaced apart manner on a base having an outer wall disposed about the brushes. A hanger engages a bath or shower enclosure member and includes a hook for insertion within an opening in said base. Handles on the base facilitate relocation of the base from a stowed position on the hanger into place on a wall surface. Wall attachment is by suction cups on the rear side of the base with a lever provided for urging the base away from a supporting wall surface and facilitating return of the brush assembly to a stowed position. A double sided adhesive member may be used to permanently secure the base to a wall surface.

3 Claims, 1 Drawing Sheet

BRUSH ASSEMBLY FOR BATH OR SHOWER USE

BACKGROUND OF THE INVENTION

The present invention concerns generally wall mounted brushes, sponges or other body massaging devices.

Previous efforts to provide wall attachable brushes, sponges, etc., adjacent a tub or in a shower stall are disclosed in U.S. Pat. Nos. 4,417,362; 4,020,519; 3,631,560 and 3,750,226 to mention a few. Apparently, for one or more reasons, the disclosed arrangements have not found wide acceptance with the public as they are not readily available in retail establishments. One drawback to the disclosed arrangements is their more or less permanent fixation on a wall surface which hinders periodic cleaning, bathing or showering and detracts from room appearance. Further, the known units reduce shower stall or tub areas when left in place. No convenient storage in proposed in the above patent disclosures.

SUMMARY OF THE PRESENT INVENTION

The present invention is embodied in a brush assembly for temporary attachment to a wall surface for use during bathing or showering and thereafter conveniently removable and storable in an inconspicuous manner.

The brush assembly includes a base adapted for rested engagement with a hanger in place on a shower curtain rod or door channel. The base is equipped with sheet of material having a multitude of suction cups and lever means to assist the user in base removal from a wall surface. Handles on the base are also directed toward convenient handling of the base. Brushes are confined on the base by walls on the base perimeter. Said lever means is stowed on the base when not in use. The brushes used are preferably of conventional construction and size permitting the user to best suit his or her needs by brush selection.

Important objectives include the provision of a brush assembly for use during bathing or showering after which same is conveniently detached from a wall surface and stowed in a concealed manner behind a shower curtain or door; the provision of a brush assembly including lever means for removal of the assembly from a wall surface.

DETAILED DESCRIPTION OF THE PREFERRED EMBODIMENTS

Figure 1:
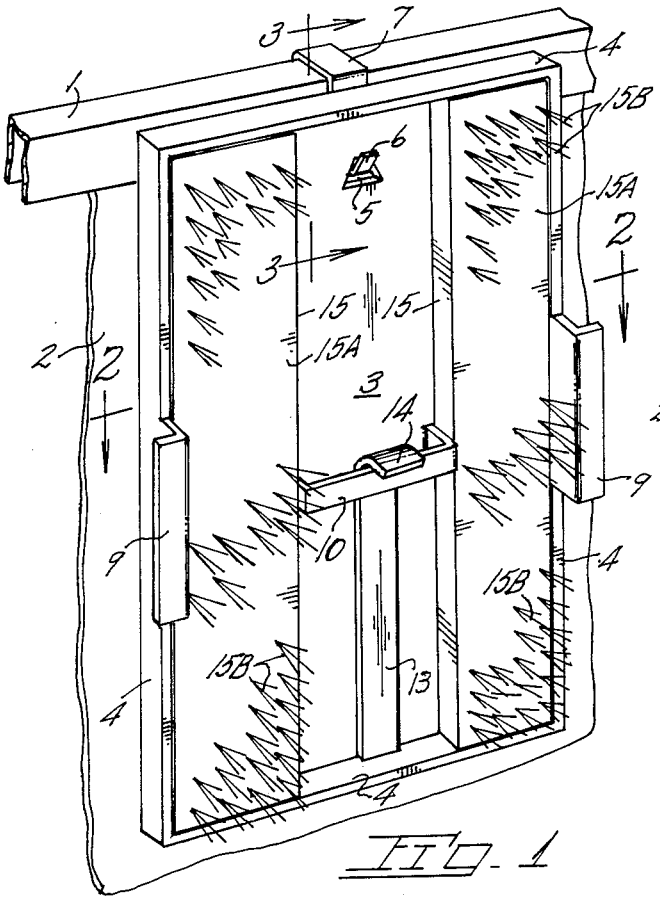
FIG. 1 is a perspective view of the present brush assembly with a supporting bath enclosure door frame shown in fragmentary form.
Figure 3:
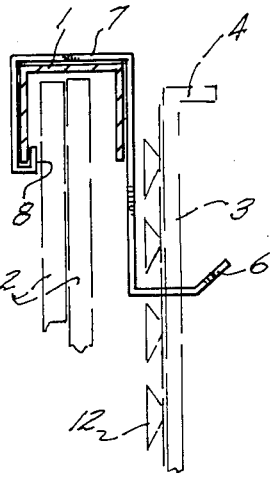
FIG. 3 is a vertical sectional view taken along line 3—3 of FIG. 1 with the brush assembly shown in phantom lines.
Figure 2:
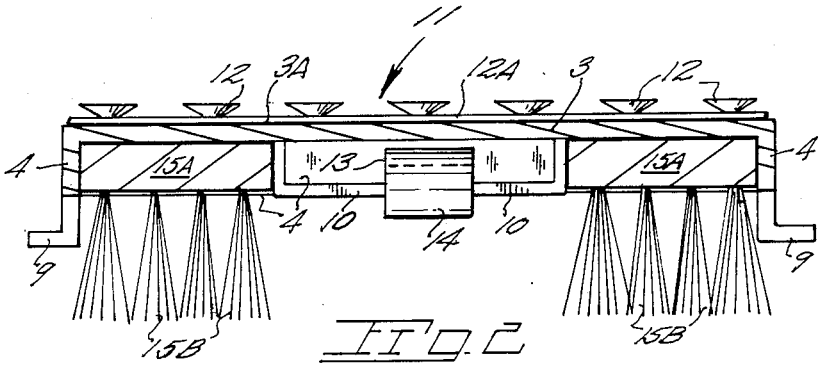
FIG. 2 is a horizontal sectional view taken along line 2—2 of FIG. 1.
Figure 4:
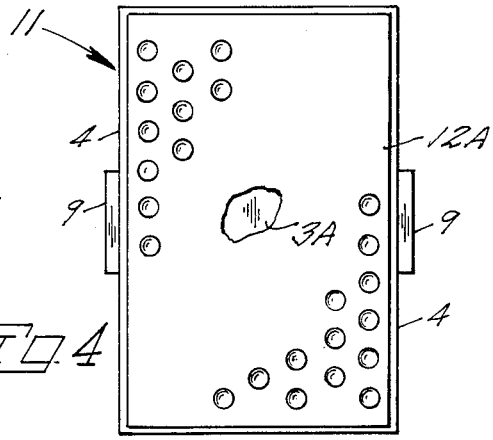
FIG. 4 is a rear elevational view of the brush assembly.

With continuing attention to the drawings wherein applied reference numerals indicate parts similarly hereinafter identified, the reference numeral 1 indicates a frame member of a tube or shower enclosure of the type having one or more slidable panels as at 2.

The brush assembly includes a rectangular base 3 having a wall 4 about its perimeter. Base 3 defines an opening 5 for inserted reception of a hook 6 of a hanger 7 which is of hook shape for hooked engagement at 8 with frame member 1.

With attention to base 3, the same includes a pair of handles at 9 while a third handle is indicated at 10. The handles 9 are disposed on the base vertical side walls to permit convenient handling of the brush assembly when moving same from a stowed position on hanger 7 to an operative position in place on a tub or shower wall surface.

The brush assembly includes a suction cup member 11 fixed in place on a rear side 3A of the base. Suction cup member 11 includes a multitude of suction cups 12 to provide for secure attachment of the brush assembly to a wall surface at a selected height without risk of accidental dislodgement. A suction cup sheet is at 12A.

Detachment of base 3 from a supporting wall is effected by means of a lever 13 having an end 14 offset for the purpose of insertion between an existing wall surface and the rear side 3A of the base whereupon rotation of handle 13 imparts outward movement in a prying manner to the base to release the suction cups from the wall surface.

In place within base 3 and particularly parametrical wall 4 thereof are brush members 15. The brush members each include a head or rigid structure 15A and bristles 15B. The depth of the brush heads 15A is preferably approximately equal to the depth of base wall 4. Further, the length of the brushes is such as to assure confinement between the upper and lower base walls while the width of the brush heads is such as to fit snugly in place between the vertically disposed base walls 4 and the ends of handle 10. Securement of the brush heads to the base 3 may be by a suitable adhesive preferably one that permits brush replacement without damage to the base.

Figure 5:
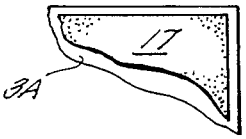
FIG. 5 is a fragmentary rear elevational view showing modified attachment means.

In FIG. 5 a modified attachment means is shown comprising an adhesive sheet 17 of the type having both sides treated with an adhesive. In this form of the invention, the center handle 10 may be used to support various items used during bathing or showering.

The brush members 15 may be of the stiffness to suit individual preferences with a range of same being presently commercially available for other uses.

While I have shown but a few embodiments of the invention, it will be apparent to those skilled in the art that the invention may be embodied still otherwise without departing from the spirit and scope of the invention.

Having thus described the invention, what is desired to be secured in a Letters Patent is:

I claim:

1. A brush assembly for temporary attachment to a wall surface of a shower stall or a wall surface adjacent a tub, said assembly comprising, a base including wall attachment means, a pair of handles on said base and projecting forwardly therefrom, said base defining an opening for the reception of a hanger, a centrally disposed handle on said base, brush components each having a head affixed to said base on opposite sides of said centrally disposed handle, and lever means carried by said base and said centrally disposed handle and manually operable to bias said base away from a base supporting wall surface.

2. The brush assembly claimed in claim 1 additionally including a hanger adapted for supported engagement with a bath enclosure frame member, said hanger terminating at one end in a hook shape to prevent accidental displacement from said frame member.

3. The brush assembly claimed in claim 1 wherein said lever means includes an offset end segment for insertion between said base and a wall surface whereupon the base may be pried away from the wall surface by lever movement.

* * * * *